US006390708B1

(12) United States Patent
Gueret

(10) Patent No.: US 6,390,708 B1
(45) Date of Patent: May 21, 2002

(54) APPLICATION DEVICE AND SYSTEM HAVING HELICAL-GROOVED BRISTLES, AND METHOD OF APPLYING A PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/621,704

(22) Filed: Jul. 21, 2000

(30) Foreign Application Priority Data

Jul. 22, 1999 (FR) ..... 99 09528

(51) Int. Cl.[7] ..... A46B 11/00

(52) U.S. Cl. ..... 401/122; 401/121; 401/118; 401/129; 15/207.2

(58) Field of Search ..... 401/122, 121, 401/118, 129, 126; 132/216, 218, 320, 317; 15/207.2, 207, 206, 159.1

(56) References Cited

U.S. PATENT DOCUMENTS

| | | | | | |
|---|---|---|---|---|---|
| 2,434,533 | A | * | 1/1948 | Wurzburger | 428/371 |
| 4,927,281 | A | * | 5/1990 | Gueret | 401/129 |
| 4,974,612 | A | * | 12/1990 | Gueret | 132/218 |
| 4,993,440 | A | | 2/1991 | Gueret | |
| 5,020,551 | A | | 6/1991 | Gueret | |
| 5,063,947 | A | * | 11/1991 | Gueret | 132/218 |
| 5,197,497 | A | | 3/1993 | Gueret | |
| 5,357,647 | A | | 10/1994 | Gueret | |
| 5,725,954 | A | * | 3/1998 | Montsinger | 428/397 |
| 5,762,432 | A | | 6/1998 | Dunleavy et al. | |
| 6,076,531 | A | * | 6/2000 | Gueret | 132/218 |
| 6,094,769 | A | * | 8/2000 | Driesen et al. | 15/207.2 |
| 6,161,243 | A | * | 12/2000 | Weihrauch | 15/167.1 |
| 6,220,254 | B1 | * | 4/2001 | Gueret | 132/313 |

FOREIGN PATENT DOCUMENTS

| | | |
|---|---|---|
| DE | 195 33 815 | 3/1997 |
| FR | 2 607 372 | 6/1988 |
| FR | 2 687 055 | 8/1993 |
| FR | 2 759 872 | 8/1998 |
| GB | 1 053 282 | 12/1966 |
| WO | WO 93/00235 | 1/1993 |
| WO | WO 97/10374 | 3/1997 |

OTHER PUBLICATIONS

English language Derwent Abstract of DE 195 33 815.
English language Derwent Abstract of FR 2 759 872.

* cited by examiner

*Primary Examiner*—Gregory L. Huson
*Assistant Examiner*—Huyen Le
(74) *Attorney, Agent, or Firm*—Finnegan, Henderson, Farabow, Garrett & Dunner, L.L.P.

(57) ABSTRACT

An application device for applying a cosmetic product includes a stem and an application element on the stem. The application element includes a plurality of bristles configured to apply a cosmetic product. The plurality of bristles include at least one first bristle having a surface with at least one helical groove extending over at least a portion of its length. The first bristle can additionally have a cross-section with at least one hollow portion. The hollow portion may be formed on the surface of the first bristle or inside the first bristle. Optionally, the plurality of bristles can include at least one second bristle having a cross-section with at least one hollow portion. Again, the hollow portion may be formed on the surface of or inside the second bristle. The second bristle may further include a helical groove extending over at least a portion of its length.

78 Claims, 7 Drawing Sheets

APPLICATION DEVICE AND SYSTEM HAVING HELICAL-GROOVED BRISTLES, AND METHOD OF APPLYING A PRODUCT

The invention relates to an application device equipped with a number of bristles for applying, to a surface such as the skin and its superficial growths, a product of liquid to pasty or pulverulent consistency, for example, a cosmetic or dermatological product. The invention also relates to an application system containing the product and equipped with such an application device.

The present invention can also relate generally to an application system having a reservoir containing the product and equipped with an open end to which a cap is removably attached. The cap acts as a handle, or element for grasping. The cap is secured to an application element, generally by way of a wand, so that when the assembly is closed, the application element remains immersed in the product.

The reservoir is, for example, intended to contain either a make-up product or dermatological product, for example, a mascara, a liquid lipstick, an eyeliner, a powder of the blusher type, nail varnish, or a hair treatment. A dose of this product is withdrawn using such an application device and is applied to the surface that is to be treated.

Many application devices of this type have been proposed in the past with a view toward applying mascara to the eyelashes, varnish to the nails, powder to the cheeks, or dye to the hair.

It is known from FR-A-2,607,372 to produce an applicator in the form of a mascara brush including bristles, each having at least one straight capillary groove at its surface running in a straight line along its entire length. The capillary grooves constitute sites which hold reserves of mascara, allowing swift and effective transfer of the mascara onto the eyelashes at the time of application with a view toward uniform application of the make-up.

In addition, it is known from FR-A-2,759,872 to produce a mascara applicator for eyelashes, comprising a handle of roughly flat profile bearing an application element having of a number of bristles embedded in a first end of the handle in an arrangement that is perpendicular to a plane passing through the handle. The bristles may have a section (or cross-section) in the shape of a cross, a semicircle, or an S. Thus, the bristles have, one or two straight grooves, respectively, at their surface.

Furthermore, FR-A-2,687,055 discloses a nail varnish applicator which has a tuft made of two types of bristles, which bristles may exhibit at least one longitudinal capillary groove.

Another source, WO 97/10374, describes a method of manufacturing twisted fibres of non-circular cross-section obtained by twisting monofilaments about their central axes. The cross-section of the monofilaments is not a cylinder of revolution. This document quotes fibres of oval or polygonal cross-section or monofilaments which have a core with at least one rib extending in a helix about the core of the filament. Such fibres are twisted after extrusion. This document describes the use of these fibres for various kinds of abrasive or cleaning brushes, or alternatively, for toothbrushes.

Although these conventional applicators are, on the whole, satisfactory, it has become desirable to have an application device which makes it possible to achieve a make-up effect which is both very heavy and very uniform, and which dispenses a greater capacity of product than the known applicators. The problem is that the above-mentioned applicators may have the drawback of losing a significant proportion of their load of product, particularly when the application element is subjected to a wringing-out operation prior to application. This drawback can be even more significant when the grooves or capillary grooves of the bristles are scraped along their entire length during this wringing-out operation.

Therefore, an object of the invention is to provide an applicator which, particularly after wringing-out, has a substantial reserve of product. Specifically, the invention is directed to controlled application of the product, regardless of the region of the application element that is brought into contact with the support that is to be treated. An applicator of this kind is suited, in particular, for the application of make-up to the eyelashes or eyebrows, the lips, the skin, or the nails, or to a hair or dermatological treatment.

Another object of the invention is to provide an applicator which remains simple and economical to manufacture and practical to use. Furthermore, when the product that is to be applied is relatively fluid, the object of the invention is to gain better control over the speed at which the product flows during application.

Another subject of the invention pertains to an applicator for applying mascara to eyelashes, which is capable of applying make-up very evenly to the eyelashes. More particularly, one of the subjects of the invention includes a mascara brush with bristles capable of being laden more heavily with mascara than a conventional mascara brush.

Indeed, the present inventor has observed that the intersection of the lashes with bristles which have a helical groove, with which a mascara brush is equipped, hugs the shape of all of the lashes of an eyelid. Unlike the brushes of the prior art, a brush such as this causes the entire surface of each eyelash to be coated fully and more uniformly. Thus, when the user applies the brush to her eyelashes, she loads the base of the lashes with mascara across the entire width of the eyelid. Thereafter, twisting the brush about its central axis, she gradually releases the mascara loaded into the groove or grooves of the bristles over the entire surface of each eyelash, combing the lashes out and separating all the eyelashes along their entire length. A brush such as this makes it possible to obtain a make-up effect which is simultaneously heavy, uniform, lengthening and curling.

Yet another object of the invention includes a brush for applying a varnish to the nails, and having controlled-flow properties.

It should be understood that the invention could still be practiced without performing one or more of the objects and/or advantages described above. Still other objects will become apparent from the detailed description which follows.

To achieve those and other advantages, and in accordance with the purposes of the invention, as broadly described herein, the invention includes an application device for applying a cosmetic product, including a stem and an application element on the stem. The application element includes a plurality of bristles configured to apply a cosmetic product. The plurality of bristles include at least one first bristle having a surface with at least one helical groove extending over at least a portion of its length.

Another aspect of the present invention provides an application device where the first bristle additionally includes a cross-section with at least one hollow portion. The hollow portion may be formed on the surface of the first bristle or inside the first bristle.

In yet another aspect of the invention, the plurality of bristles include at least one second bristle having a cross-section with at least one hollow portion. Again, the hollow portion may be formed on the surface of or inside the second bristle. The second bristle may optionally include a helical groove extending over at least a portion of its length.

According to another aspect of the invention, the plurality of bristles include a plurality of first bristles having a surface with at least one helical groove extending over at least a portion of a length of each of the first bristles. In a further aspect the plurality of bristles include a plurality of bristles each having a cross-section with at least one hollow portion. In another aspect, at least one of the bristles having a cross-section with at least one hollow portion also includes at least one helical groove extending over at least a portion of its length. Alternatively, the plurality of bristles having a cross-section with at least one hollow portion may not have a helical groove extending over at least a portion of its length.

In yet another aspect, the plurality of bristles include at least one bristle with at least one helical groove extending over at least a portion of its length and a plurality of bristles each having a cross-section with at least one hollow portion.

According to another aspect, the application element comprises at least one tuft including the bristles, the bristles being oriented roughly mutually parallel, one end of the tuft being fixed to a stem. When the application element is formed with a single tuft of bristles, it is possible to obtain an application device which is particularly well suited to the application of a nail varnish, such as a nail varnish brush. An application element such as this may also be shaped into a blusher-type brush, allowing a powder to be applied to the face, or into an eyeliner brush for making-up the eyebrows.

Some preferred embodiments of the invention include a handle on an end of the stem opposite to the application element. In place of, or in addition to, the handle, at least a portion of the stem could be configured to be grasped by a user during application of a product.

According to one particular arrangement of the invention, a free end of the application element maybe attached to a support. In this case, the application element is arranged in a plane of the support and oriented transversely with respect to a longitudinal axis of the application device. An arrangement such as this may preferably be adopted for an application device for applying mascara to the eyelashes.

According to another embodiment, the bristles are oriented approximately radially on the application element, with respect to a central core or an off-center core. In this case, the application device may be used as a mascara brush or as an applicator for applying hair dye to the hair.

Preferably, a core such as this is formed by twisting together two branches of metal wire in such away as to trap the bristles between the twisted-together branches of the core. In this case, the brush obtained is one of the "bottle-brush" type. Preferably, the core defines an axis coincident with the axis of the applicator.

The application device may have varying exterior shapes. Thus, the outer profile of the application device, formed by the ends of the bristles, can be tailored to suit, according to the nature of the product to be applied and the morphology of the support. This profile can be obtained, for example, by trimming using a trimmer. The application device may include a combination of bristles of a first length and bristles of a second length greater than the first. The application device may include bristles of any number of varying lengths.

Furthermore, all or some of the bristles of the application devices according to the invention may be of any type. For example, the bristles can have tapered, rounded, forked, or pinhead ends, or may have undergone any kind of treatments known to those skilled in the art. Further, these bristles may be corrugated in a plane or formed as a stretched-out spiral. The cross-section of the bristles may preferably be sized to lie inside a circle of a diameter ranging from about 6/100ths of a mm to about 30/100ths of a mm.

Depending on the nature of the application element and that of the product to be applied, the length of the bristles may range from approximately 2 mm to approximately 25 mm. In the case of a brush of the "bottle-brush" type, the length of a bristle is defined by the distance between its two free ends. In this case, the length of the bristles is, for example, of the order of about 7 mm to about 12 mm.

The bristles may be made, for example, of a material comprising at least one of polyamide, polyester, polyethylene, polypropylene, polyvinyl chloride, polytetrafluoroethylene, polyethyleneterephthalate or thermoplastic elastomer.

Preferably, the helical groove has a pitch ranging from about 1 mm to about 20 mm, and more preferably from about 1.5 mm to about 10 mm, or even more preferably from about 2 mm to about 9 mm. Preferably, the groove has a depth such that the ratio between the depth of the groove and the diameter of the circle inside which the cross-sections lie is from approximately 1/10 to approximately 9/10. Purely by way of example, the depth of the groove may range from about 2/100ths of a mm to about 8/100ths of a mm.

Preferably, the shape of the cross-section of the bristles is chosen from cross-sections in the shape of: a cross; a trefoil; a quatrefoil; a hollow oval; a hollow cylinder; a hollow rectangle; a hollow polygon; a figure-8, a C, an S, an E, an F, an H, an I, an L, an N, a W, a V, a star, or a crescent.

A further aspect of the invention provides an application system including the application device and a reservoir configured to contain the product to be applied. In an application system such as this, in order to be able to meter out the product correctly and to spread it uniformly onto the application element, in some instances a wiper, such as a wringing-out member, may be provided preferably near the open end of the reservoir. A wiper such as this is intended to meter out the amount of product withdrawn by the application device and to spread it out evenly on the application element.

Preferably, a wiper such as this is made of an elastomeric material, possibly a foam, and has at least one passage through which the application element and, as appropriate, a portion of a stem, or wand, can pass. The passage through the wiper may include at least one open or contiguous wiping lip. When the application element is on a flat stem, this passage may be in the form of at least one slit extending across a substantial part of the cross-section of the wiper.

In a preferred embodiment of the invention, the reservoir contains a quantity of a cosmetic product, preferably an eye makeup product such as mascara or a nail treatment product such as nail varnish.

In yet another aspect of the invention, the application system includes a handle on an end of the stem opposite the application element. A portion of the handle may be configured to removably cover an opening in the reservoir.

Another aspect of the invention provides a method of applying a product to a surface region of the body, such as an eyelash, fingernail, toenail, or the like. The method includes providing the application device, placing a product on the application element of the device, and transferring the product from the application element to a surface region. Preferably, the product is an eye makeup product or a nail treatment product.

Apart from the provisions explained hereinabove, the invention includes other arrangements which will be dealt with more fully hereinafter with regard to some embodiments which are described with reference to the drawings appended hereto, but which are not in any way limiting. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 depicts a view in axial section of a mascara applicator assembly, according to a first embodiment of the invention;

Figure 1:
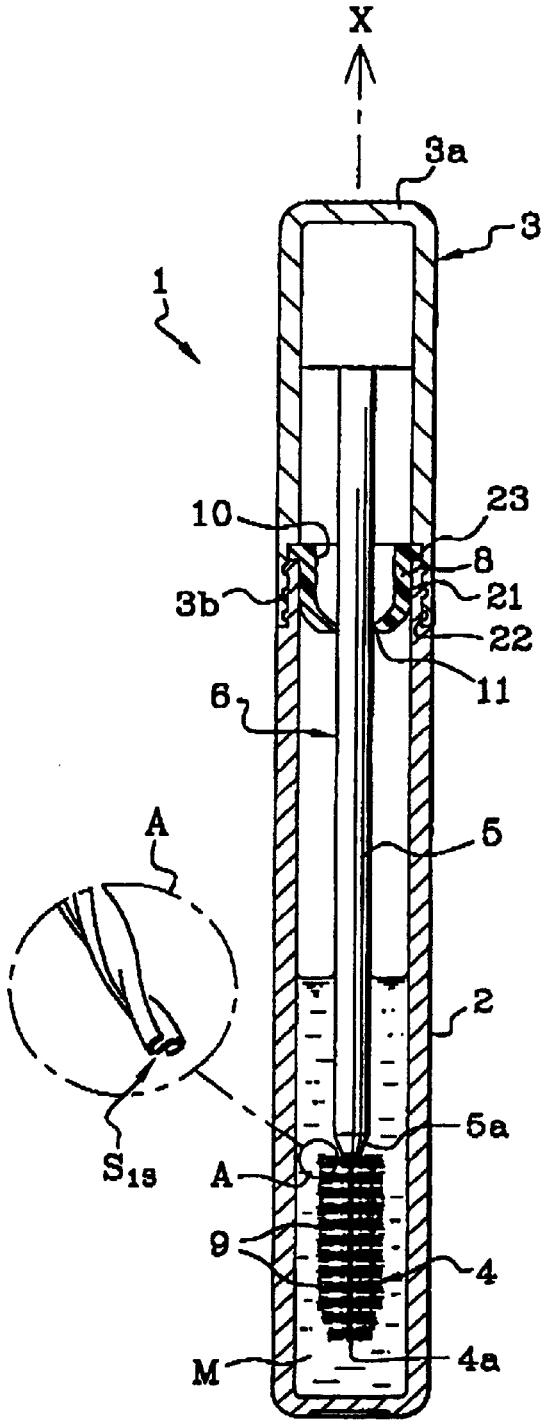

Reference will now be made in detail to the present preferred embodiments of the invention, examples of which are illustrated in the accompanying drawings. Wherever possible, the same reference symbols are used in the drawings and the description to refer to the same or like parts, and the same reference symbols with different alphabetical suffixes are used to refer to similar parts.

As shown in FIG. 1, a mascara applicator system 1, of central axis X, for applying a product M contained in a cylindrical reservoir 2 is equipped with an application device 6. The application device 6 includes a cap 3 which can be attached, for example, by screwing, onto the neck 21 of the reservoir. The cap 3 includes an outer, upper region 3*a* that can act as a handle, or element for grasping. The neck 21 has an external screw thread 22 capable of cooperating with a complementary screw thread 3*b* formed on the lower portion of the interior surface of the cap 3. The cap 3 is in the overall shape of an elongate cylinder defining a handle easy to hold in the hand.

The cap 3 is equipped with a stem 5 emerging from the lower side of the cap 3. In FIG. 1, the stem is configured as a wand. This wand 5 has a lower end 5*a* to which an application element 4 is attached, for example by bonding or by being inset therein.

The neck 21 of the bottle has a free circular edge 23 defining an opening 10. Mounted in this opening is a wiper 8, formed of an elastically deformable material. The wiper, or wringing-out member, is in the form of a thimble, having an end facing towards the reservoir 2. The end is open, so as to form a circular wiping lip capable, as the application device 6 is extracted from the reservoir, of removing excess product from the wand 5 and the application element 4. In the storage position, the wiper 8 has the wand 5 passing through it.

The application element 4 shown in FIG. 1 is a brush for applying mascara to the eyelashes, comprising an elongate core 4*a* formed by twisting together two branches of metal wire bent into a U-shape. The core 4*a* is attached by force-fitting to the end 5*a* of the wand 5. Bristles 9 are implanted radially between the wires of the core 4*a*. When the branches of the wire are twisted together, the bristles 9 are trapped and held between the turns of the core 4*a*. Detail A of FIG. 1 shows a twisted bristle of S-shaped cross-section, $S_{13}$.

The core 4*a* may be centrally positioned, as shown in FIG. 1. In FIG. 1, the core 4*a* defines an axis that coincides with the axis X of the brush. The core may also be off-center with respect to the circle in which the bristles lie. The bristles 9, made of synthetic and possibly flocked fibres, are chosen from bristles such as those illustrated, without any implied restriction, in FIGS. 4 to 19. The application element 4 may include a combination of bristles of differing types, i.e., having differing diameters, shapes, cross-sections, elasticity, materials, and the like. The application element may also have any known exterior shape obtained, for example, by cutting the ends of the bristles 9 using a trimmer.

The application element according to the invention may be heavily laden with mascara. When the application element is placed in contact with eyelashes, the base of the eyelashes can become heavily laden with mascara. When the user turns the brush 1 about its axis, the lashes continue to be in contact with the application element along their entire length and continue to become laden with mascara, while at the same time being curled. The bristles then begin to comb the lashes. When the user continues to rotate the application element about its axis, the lashes are gripped by the bristles in a groove G, the orientation of which can vary according to the extent to which the lashes interpenetrate the brush. The mascara product is thus spread out over substantially the entire periphery and along substantially the entire length of each lash while combing it. In other words, while the make-up is being applied, the micro reservoirs that the grooves constitute change position with respect to the lash that is to be treated, affording uniform coating of the lash.

Thus, each lash is loaded substantially uniformly, both along its entire length and around its entire periphery. There is preferably no noticeable difference in make-up between the lashes at the end of the eyelid and those in the middle. Preferably, the lashes are perfectly separated from one another, lengthened, and curled.

Figure 2:
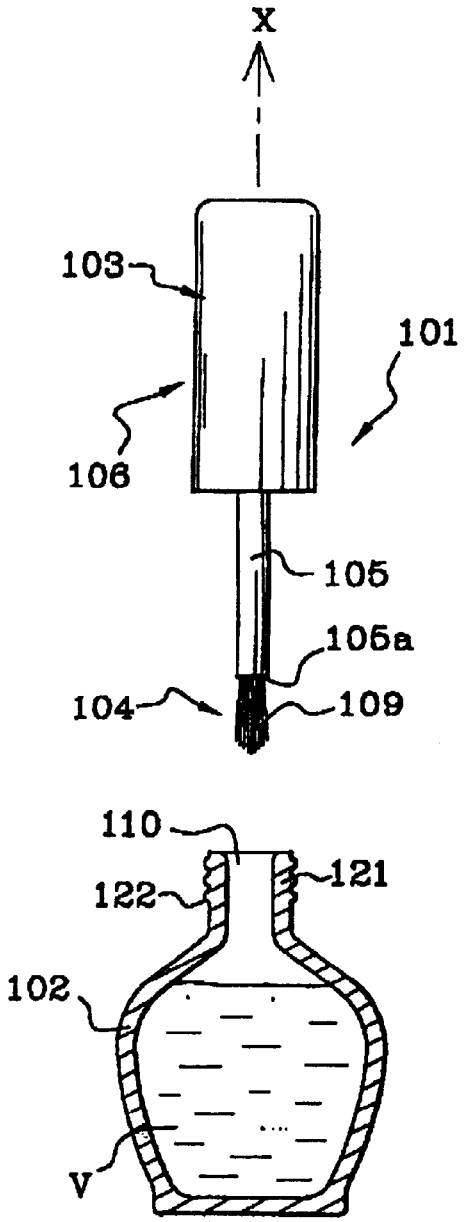
FIG. 2 depicts a view in axial section of a nail varnish applicator assembly, according to a second embodiment of the invention.

FIG. 2 shows an application system denoted overall by the reference 101, comprising a reservoir 102 which has a longitudinal axis X of symmetry and an application device 106 equipped with a collar, or handle, 103. The reservoir 102, preferably made of glass, contains a liquid or viscous product V that is to be applied, and which may, for example, be a nail varnish composition.

The reservoir 102 has a neck 121 defining an opening 110. The neck 121 has a screw thread 122 capable of cooperating with a complementary screw thread made on the inside of the collar 103. The collar 103 includes an outer, upper region 103*a* that can act as a handle, or element for grasping.

The collar 103 is attached to one end of a stem 105, and the opposite end of the stem 105 is connected to an application element 104. In this particular instance, the application element 104 is formed of a tuft of bristles 109 fixed to a free end 105*a* of the stem 105. In this embodiment, the stem 105 is configured as a wand.

When the applicator assembly is closed by screwing the collar 103 onto the reservoir 102, the tuft 104 of bristles 109 dips into the product V. These bristles 109 include those described above, and are preferably chosen from the bristles shown in FIGS. 4 to 19.

When the user wishes to apply some product, she unscrews the cap and extracts the application element from the reservoir. If the application element holds an excess of product, the user wipes it against the free edge of the neck 121 to wring out any excess product.

It should be noted that the application element preferably remains well laden and has a good ability to hold on to the varnish, even after a number of wiping, or wringing-out, passes, without forming drops. The varnish may be deposited on the nail at a flow rate which is both reduced and roughly constant. Preferably, the coat of varnish obtained is more even than that obtained with a conventional applicator, and the varnish dries appreciably more quickly.

Figure 3:
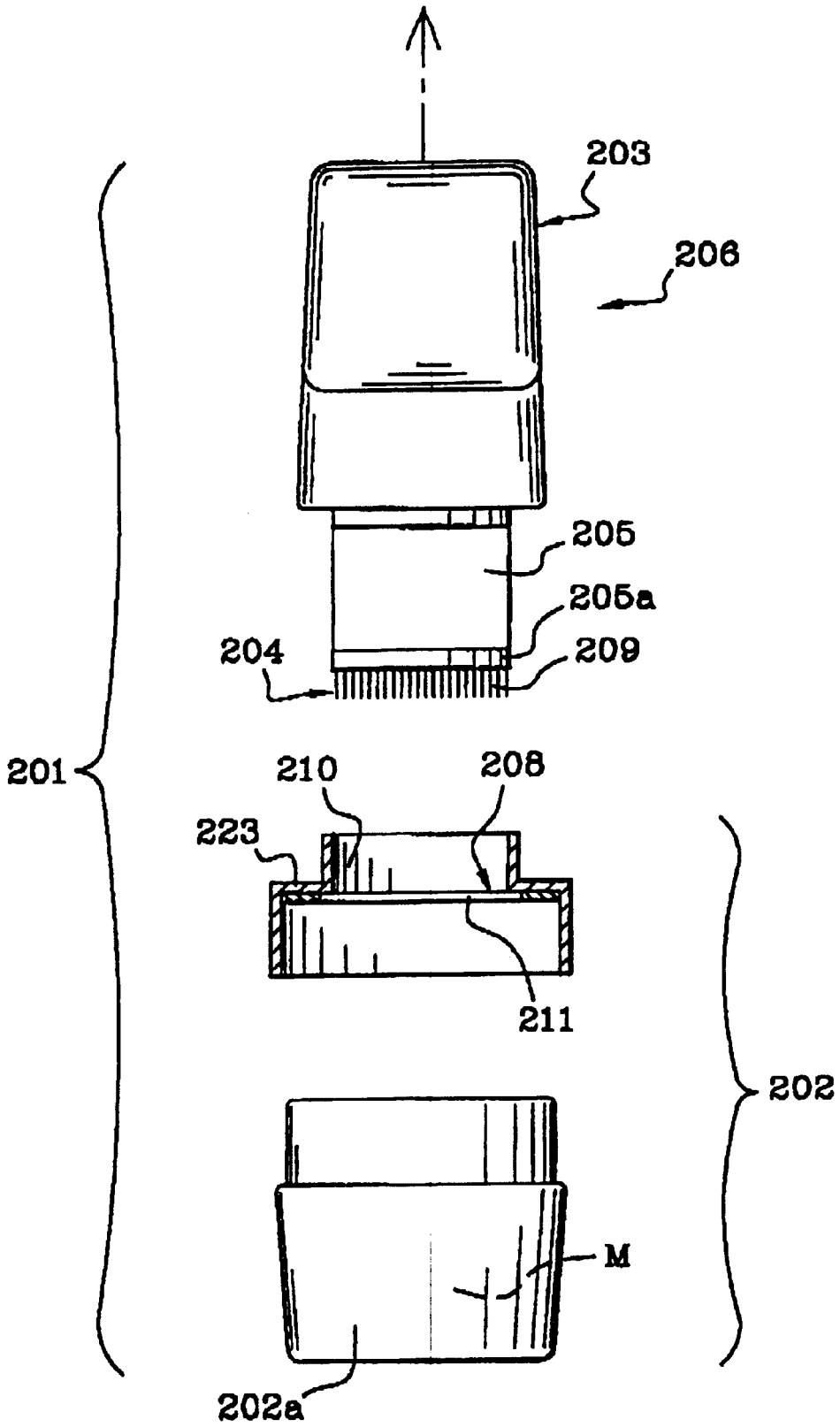
FIG. 3 depicts a view in axial section of a mascara applicator assembly, according to a third embodiment of the invention.

FIG. 3 shows an application device 206 in the form of a mascara brush, which differs from the one depicted in FIG. 1 in that the stem 205 is configured as a generally flat, planar member. At its free end 205*a*, the stem 205 is connected to an application element 204 having a collection of bristles 209. The application element 204 is arranged in the plane of the stem 205, roughly at a right angle to an axis of the application device 206. The bristles 209 are preferably substantially parallel to the axis of the device 206, and are of the same kind as those described with reference to FIGS. 1 and 2. The other end of the stem 205 is attached to a collar 203. The collar 203 includes an outer, upper region 203*a* that can act as a handle, or element for grasping.

The mascara brush 206 forms part of a make-up application system 201 including a reservoir 202 containing a product M, surmounted by an element 222 that carries a wiping, or wringing-out, device. The element that carries the wiping device has a neck 210 onto which the collar 203 can be fixed. The element that carries the wiping device also has a shoulder 223, on which a wiper 208 is mounted. In this particular instance, the wiper 208 is formed by an elastomer or foam membrane with a slit 211 through which, as the application element 206 is withdrawn, at least a portion of the stem 205 and the application element 204 can pass. The plane in which the bristles 209 are implanted may also be inclined with respect to the plane passing through the stem 205.

When the application element 206 is extracted from the reservoir, the brush laden with mascara passes through the slit 211 of the wiper 208. The wiping device can thus wring out, i.e., remove excess product from, the outer face of the bristles, while the helical grooves of the bristles retain a significant reserve of product.

When application elements of the invention are subjected to a wiping operation prior to the application of the product, the wiping can be performed randomly. That is, the distribution of the product through the helical profiles is such that micro-reserves of product are present on each bristle at a different place along its length. These micro-reserves are able to ensure that the product is spread out very uniformly along the support that is to be treated.

FIGS. 4 to 19 illustrate particularly preferred bristle configurations for producing the application elements 6, 106, 206 described hereinabove. The reference letter S represents the cross-section of a bristle, and is subscripted with a numerical reference identifying the particular cross-section. The cutouts, or hollow portions, of the cross-sections are indicated by the reference E, and the helical grooves formed by the cutouts are indicated by the reference G.

Figure 4:
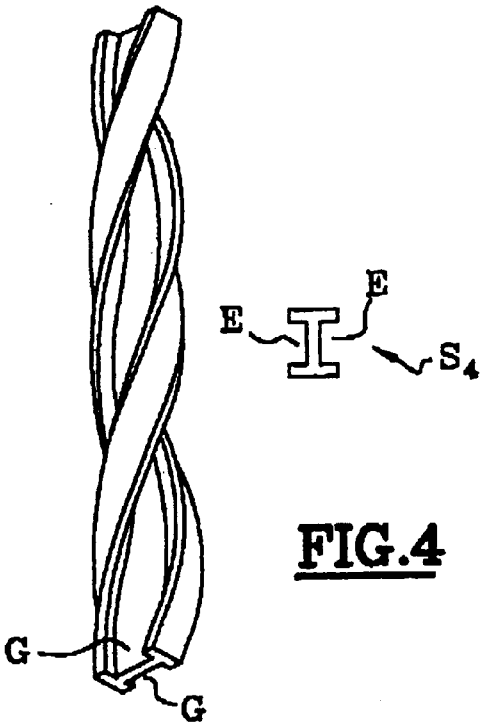
FIG. 4 is a perspective view of a bristle of one of the preferred application devices having a first cross-sectional shape.

FIG. 4 shows a bristle having a cross-section $S_4$ in the shape of an I. The cross-section includes two cutouts E forming two helical grooves G on the bristle.

Figure 5:
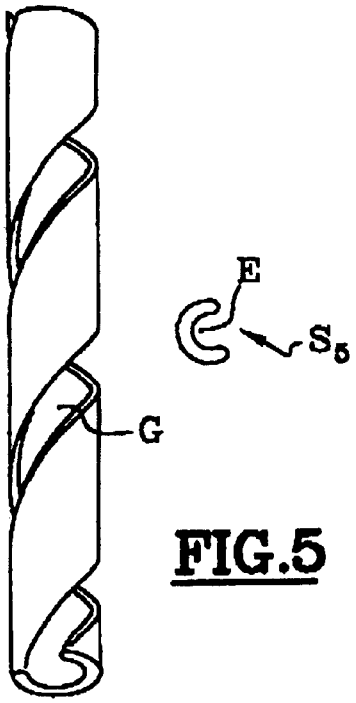
FIG. 5 is a perspective view of a bristle of one of the preferred application devices having a second cross-sectional shape.

FIG. 5 shows a bristle having a cross-section $S_5$ in the shape of a C. The cross-section includes one cutout E forming one helical groove G on the bristle.

Figure 6:
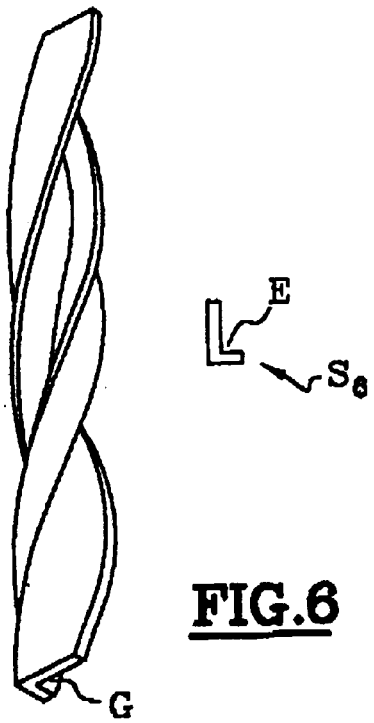
FIG. 6 is a perspective view of a bristle of one of the preferred application devices having a third cross-sectional shape.

FIG. 6 shows a bristle having a cross-section $S_6$ in the shape of an L. The cross-section includes one cutout E forming one helical groove G on the bristle.

Figure 7:
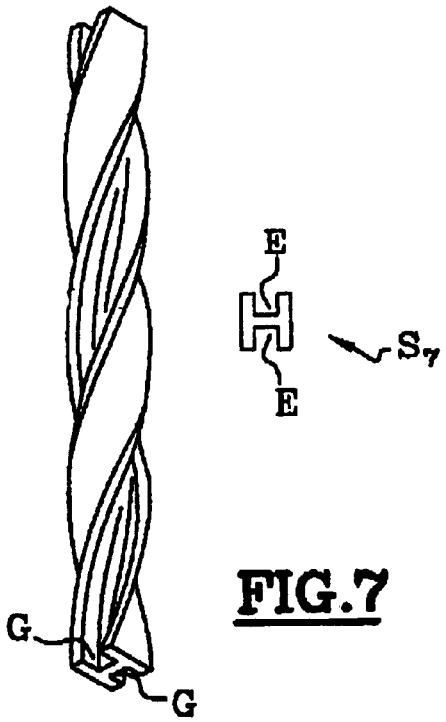
FIG. 7 is a perspective view of a bristle of one of the preferred application devices having a fourth cross-sectional shape.

FIG. 7 shows a bristle having a cross-section $S_7$ in the shape of an H. The cross-section includes two cutouts E forming two helical grooves G on the bristle.

Figure 8:
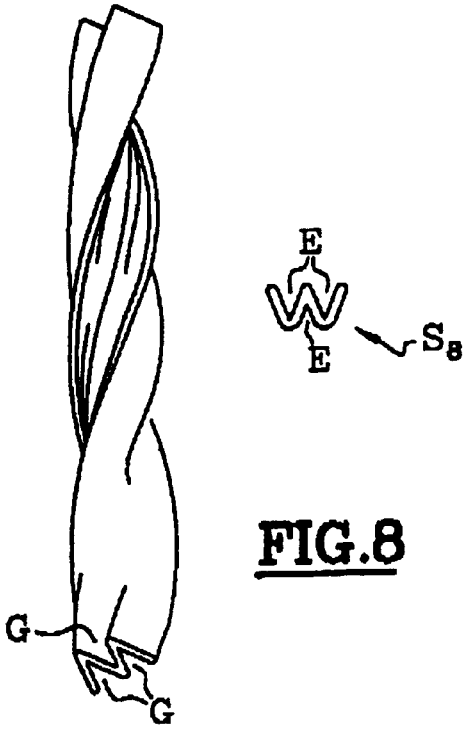
FIG. 8 is a perspective view of a bristle of one of the preferred application devices having a fifth cross-sectional shape.

FIG. 8 shows a bristle having a cross-section $S_8$ in the shape of a W. The cross-section includes three cutouts E forming three helical grooves G on the bristle.

Figure 9:
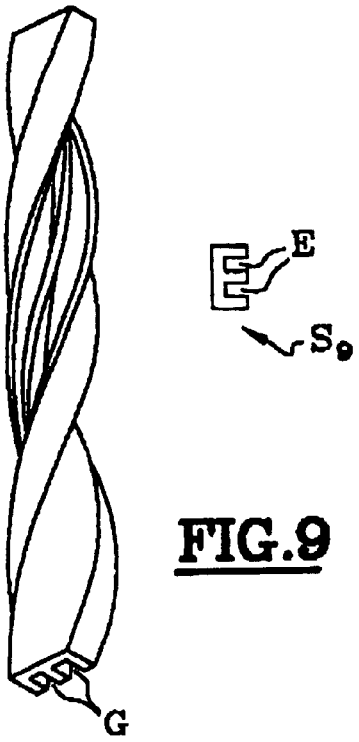
FIG. 9 is a perspective view of a bristle of one of the preferred application devices having a sixth cross-sectional shape.

FIG. 9 shows a bristle having a cross-section $S_9$ in the shape of an E. The cross-section includes two cutouts E forming two helical grooves G on the bristle.

Figure 10:
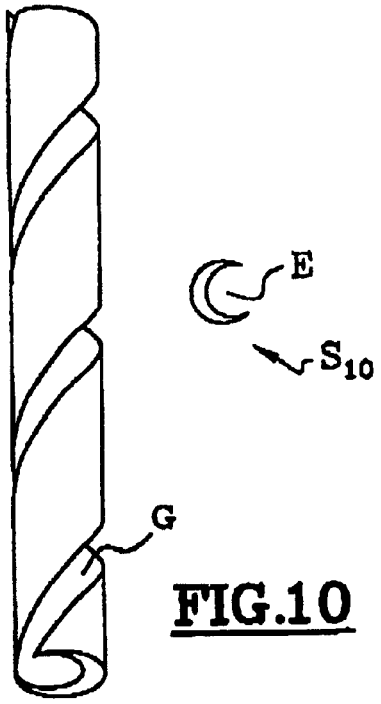
FIG. 10 is a perspective view of a bristle of one of the preferred application devices having a seventh cross-sectional shape.

FIG. 10 shows a bristle having a cross-section $S_{10}$ in the shape of a crescent. The cross-section includes one cutout E forming one helical groove G on the bristle.

Figure 11:
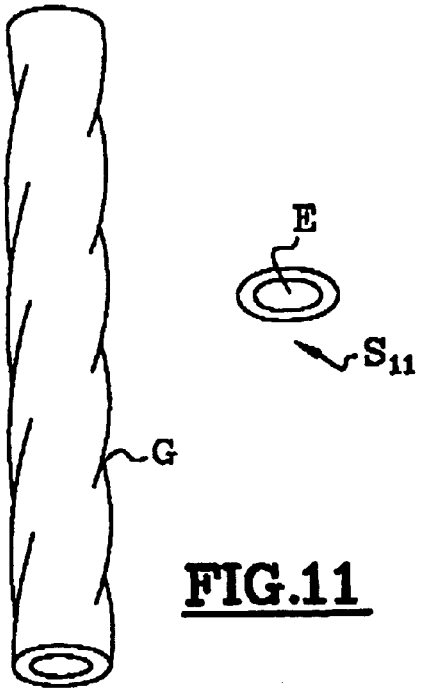
FIG. 11 is a perspective view of a bristle of one of the preferred application devices having an eighth cross-sectional shape.

FIG. 11 shows a bristle having a cross-section $S_{11}$ in the shape of an oval. The cross-section includes a central cutout E forming two shallow helical grooves G on the bristle after twisting.

Figure 12:
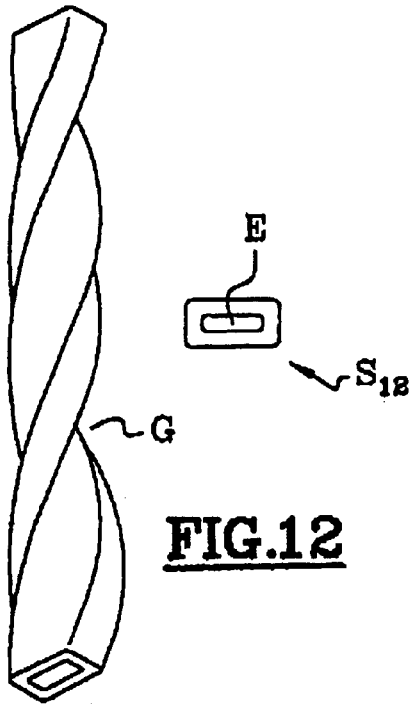
FIG. 12 is a perspective view of a bristle of one of the preferred application devices having a ninth cross-sectional shape.

FIG. 12 shows a bristle having a cross-section $S_{12}$ in the shape of a rectangle. The cross-section includes a central cutout E forming two shallow helical grooves G on the surface of the bristle after twisting.

Figure 13:
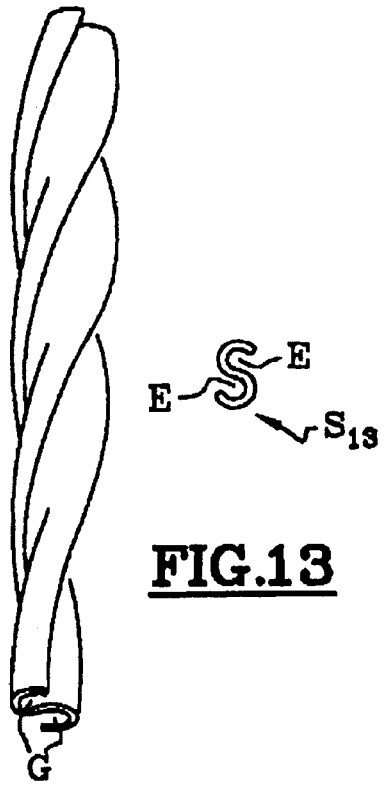
FIG. 13 is a perspective view of a bristle of one of the preferred application devices having a tenth cross-sectional shape.

FIG. 13 shows a bristle having a cross-section $S_{13}$ in the shape of an S. The cross-section includes two cutouts E forming two helical grooves G on the bristle.

Figure 14:
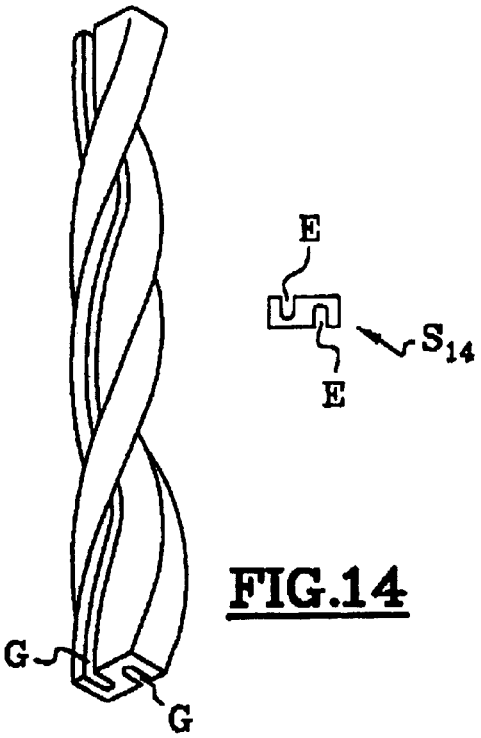
FIG. 14 is a perspective view of a bristle of one of the preferred application devices having an eleventh cross-sectional shape.

FIG. 14 shows a bristle having a cross-section $S_{14}$ in the shape of a flattened rectangle. The cross-section includes two cutouts E forming two helical grooves G on the bristle.

Figure 15:
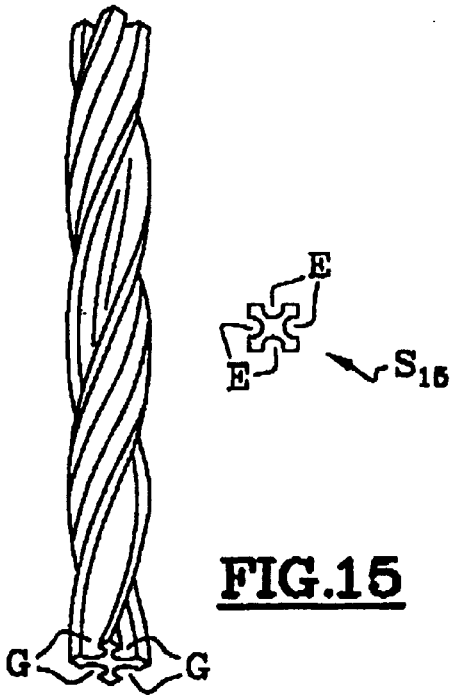
FIG. 15 is a perspective view of a bristle of one of the preferred application devices having a twelfth cross-sectional shape.

FIG. 15 shows a bristle having a cross-section $S_{15}$ in the shape of a square. The cross-section includes one cutout E on each of its faces forming four helical grooves G on the bristle.

Figure 16:
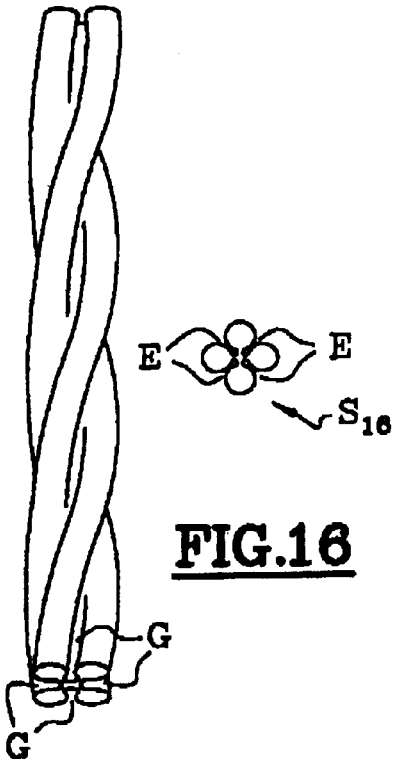
FIG. 16 is a perspective view of a bristle of one of the preferred application devices having a thirteenth cross-sectional shape.

FIG. 16 shows a bristle having a cross-section $S_{16}$ in the shape of a quatrefoil. The cross-section includes four cutouts E forming four helical grooves G on the bristle.

Figure 17:
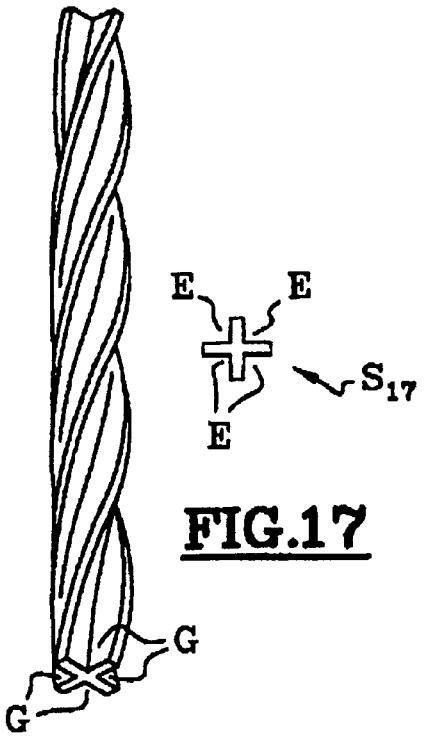
FIG. 17 is a perspective view of a bristle of one of the preferred application devices having a fourteenth cross-sectional shape.

FIG. 17 shows a bristle having a cross-section $S_{17}$ in the shape of a cross. The cross-section includes four cutouts E forming four helical grooves G on the bristle.

Figure 18:
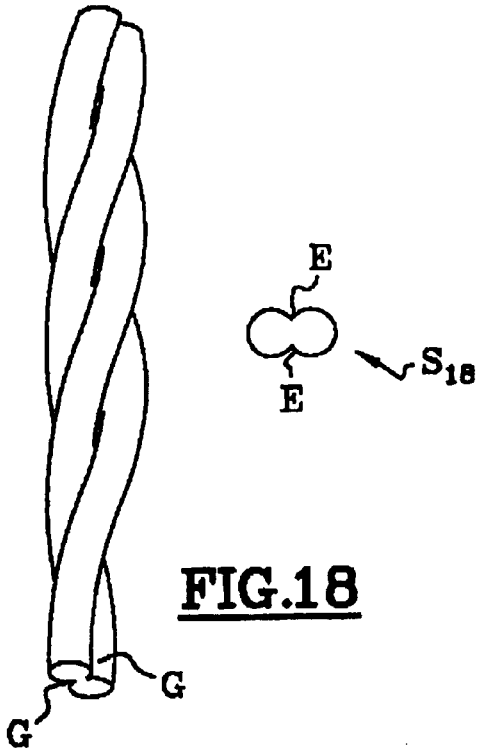
FIG. 18 is a perspective view of a bristle of one of the preferred application devices having a fifteenth cross-sectional shape.

FIG. 18 shows a bristle having a cross-section $S_{18}$ in the shape of a FIG. 8. The cross-section includes two cutouts E forming two helical grooves G on the bristle.

Figure 19:
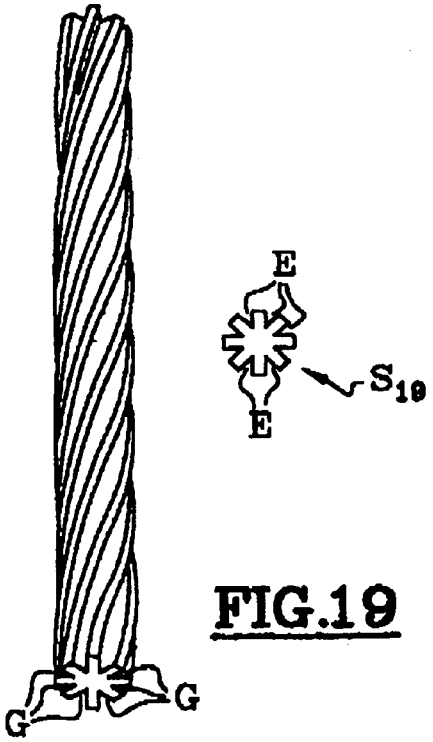
FIG. 19 is a perspective view of a bristle of one of the preferred application devices having a sixteenth cross-sectional shape.

FIG. 19 shows a bristle having a cross-section $S_{19}$ in the shape of a star. The cross-section includes a number of cutouts E forming a number of helical grooves G on the bristle.

The helical grooves may be of the left-handed type, which means that, when viewed along the axis of the bristle, they progress in the counterclockwise direction. Alternatively, the helical grooves may be of the right-handed type, which means that, when viewed along the axis of the bristle, they progress in the clockwise direction.

Thus, it is possible to produce an applicator formed exclusively of fibers in which the grooves turn in the same direction, or of a combination of fibers, some of which turn to the right while others turn to the left. It is thus possible to alter the characteristics with which the product is applied, for example to the eyelashes.

These bristles can be obtained by extruding a thermoplastic through a nozzle of an appropriate profile, then hot-twisting the extruded material to the right or left about its axis with the pitch and helical direction of the desired helical groove. The bristles used according to the present invention can be obtained by a process similar to the one described in WO 97/10374 to which reference was made above.

Preferably, the cross-section of the above bristles lies inside a circle the diameter of which ranges from about 6/100ths of a mm to about 30/100ths of a mm.

The bristles may be made of a material comprising at least one of polyamide (e.g., PA-6, PA-6,6, PA-11, PA-6,10, PA-6,12), polyester, polyethylene, polypropylene, ethylene/propylene copolymer, polyvinyl chloride, polytetrafluoroethylene, polyethylene terephthalate, or thermoplastic elastomer. If appropriate, slip enhancers, such as graphite, molybdenum disulphide or polytetrafluoroethylene may be incorporated into these materials.

It should be appreciated that these bristles of helical profile may also contain a quantity of untwisted bristles, of a cross-section well known in the prior art. By way of example, the bristles may be flat strings, or may have cross-sections which are in the shape of a circle, a polygon, trilobal, quadrilobal, an L, a C, a U, etc. These untwisted bristles may be solid or hollow, for example, hollow cylindrical.

In one applicator with bristles which may or may not have a helical profile, the diameter of the cross-section of the circle in which the bristles lie may have different diameters. Likewise, they may be made of different materials.

Figure 20:
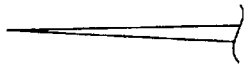
FIG. 20 is a perspective view of an end portion of a bristle having a first shape.
Figure 21:
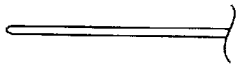
FIG. 21 is a perspective view of an end portion of a bristle having a second shape.
Figure 22:
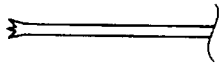
FIG. 22 is a perspective view of an end portion of a bristle having a third shape.
Figure 23:
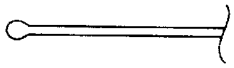
FIG. 23 is a perspective view of an end portion of a bristle having a fourth shape.

In addition, as shown in FIGS. 20–23, the bristles of the application devices of the invention may include free end portions having one or more of a variety of shapes. For example, FIG. 20 shows a bristle with a tapered end. FIG. 21 illustrates a bristle having a rounded end. FIG. 22 shows one example of a bristle having a forked end. In addition, other examples of forked-end bristle are illustrated and described in U.S. Pat. No. 5,020,551. The '551 patent also shows other alternative bristle ends that could be used with the application device of this invention. FIG. 23 illustrates a bristle with a pinhead-shaped, or rounded nailhead, end. U.S. Pat. No. 5,197,497 shows and describes bristles having a pinhead, or rounded nailhead, end.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An application device for applying a cosmetic product, comprising:

a stem; and an application element on the stem, the application element comprising a plurality of bristles configured to apply a cosmetic product, the plurality of bristles including at least one first bristle having a surface with at least one helical groove extending over at least a portion of a length of the at least one first bristle, and a core including a plurality of wire branches, the branches being twisted together to trap the plurality of bristles, wherein said at least one first bristle with at least one helical groove is inserted between the branches before the branches are twisted together.

2. The application device of claim 1, wherein the at least one first bristle has a cross-section with at least one hollow portion.

3. The application device of claim 2, wherein the hollow portion is formed on the surface of the at least one first bristle.

4. The application device of claim 2, wherein the hollow portion is formed inside the at least one first bristle.

5. The application device of claim 2, wherein a shape of the cross-section is one of a cruciform, a trilobal, a quadrilobal, a hollow oval, a hollow cylinder, a hollow rectangle, a hollow polygon, a figure-8, a C, an S, an E, an F, an H, an I, an L, an N, a W, a V, a star, and a crescent.

6. The application device of claim 1, wherein the plurality of bristles include at least one second bristle having a cross-section with at least one hollow portion.

7. The application device of claim 6, wherein the hollow portion is formed on a surface of the at least one second bristle.

8. The application device of claim 6, wherein the hollow portion is formed inside the at least one second bristle.

9. The application device of claim 6, wherein a shape of the cross-section is one of a cruciform, a trilobal, a quadrilobal, a hollow oval, a hollow cylinder, a hollow rectangle, a hollow polygon, a figure-8, a C, an S, an E, an F, an H, an I, an L, an N, a W, a V, a star, and a crescent.

10. The application device of claim 6, wherein the at least one first bristle has a cross-section with at least one hollow portion and the at least one second bristle has a surface with at least one helical groove over at least a portion of a length of the at least one second bristle, and wherein the cross-section of the at least one first bristle is different from the cross-section of the at least one second bristle.

11. The application device of claim 1, wherein the plurality of bristles extend substantially parallel to one another, one end of the plurality of bristles being fixed to the stem.

12. The application device of claim 1, further comprising a handle on an end of the stem opposite to the application element.

13. The application device of claim 1, wherein the plurality of bristles form a single tuft of bristles such that the application device is one of a nail varnish brush, a blusher brush, a lipstick brush, and an eyeliner brush.

14. The application device of claim 1, wherein the stem is substantially planar, the application element being arranged in a plane of the stem and oriented transversely with respect to a longitudinal axis of the application device.

15. The application device of claim 14, wherein the plurality of bristles extend substantially parallel to the longitudinal axis of the application device.

16. The application device of claim 15, wherein the device is configured in the form of a mascara brush.

17. The application device of claim 1, wherein the application element includes a core, and the plurality of bristles extend substantially radially from the core.

18. The application device of claim 17, wherein the device is configured in the form of a mascara brush.

19. The application device of claim 17, wherein the core includes two twisted-together branches of metal wire.

20. The application device of claim 19, wherein the plurality of bristles are trapped between the twisted-together branches of the core.

21. The application device of claim 17, wherein the core defines an axis coincident with a central axis of the application element.

22. The application device of claim 1, wherein the plurality of bristles include at least one bristle of a first length and at least one bristle of a second length, greater than the first length.

23. The application device of claim 1, wherein a shape of an end of at least one of the plurality of bristles is one of rounded, tapered, forked, and pinhead.

24. The application device of claim 1, wherein the helical groove has a pitch ranging from about 1 mm to about 20 mm.

25. The application device of claim 24, wherein the pitch ranges from about 1.5 mm to about 10 mm.

26. The application device of claim 25, wherein the pitch ranges from about 2 mm to about 9 mm.

27. The application device of claim 1, wherein a cross-section of each bristle of the plurality of bristles is sized such that the cross-section fits inside a circle having a diameter ranging from about 6/100ths of a mm to about 30/100ths of a mm.

28. The application device of claim 27, wherein the helical groove has a depth such that the ratio between the depth of the helical groove and the diameter of the circle ranges from about 1/10 to about 9/10.

29. The application device of claim 1, wherein a length of each of the plurality of bristles ranges from about 2 mm to about 25 mm.

30. The application device of claim 1, wherein the plurality of bristles comprise a material chosen from at least one of polyethylene, polypropene, ethylene/propylene copolymer, polyamide, polyester, polyvinyl chloride, polytetrafluoroethylene, polyethylene terephthalate, and thermoplastic elastomer.

31. An application system comprising:

the application device of claim 1; and a reservoir configured to contain a product capable of being applied with the application device.

32. The application system of claim 31, wherein the reservoir contains a cosmetic product.

33. The application system of claim 32, wherein the cosmetic product is one of an eye make-up product and a nail treatment product.

34. The application system of claim 31, further comprising a handle on an end of the stem opposite the application element, a portion of the handle being configured to removably cover an opening in the reservoir.

35. The application system of claim 31, further comprising a handle on an end of the stem opposite the application element, a portion of the handle being configured to removably cover an opening in the reservoir.

36. The application system of claim 31, wherein the reservoir includes an opening and a wiper configured to remove production from the application element when the application element is withdrawn from the reservoir.

37. The application system of claim 36, wherein the wiper is configured to remove excess material from the stem.

38. The application system of claim 36, wherein the wiper comprises an elastomeric material and includes at least one passage through which the application element member can pass.

39. The application system of claim 36, comprises a foam material and includes at least one passage through which the application element member can pass.

40. The application system of claim 35, wherein the wiper includes at least one slit extending across a substantial portion of a cross-section of the wiper.

41. A method of applying a cosmetic product to a surface region of a body, comprising:

providing the application device of claim 1;

placing a cosmetic product on the application element; and transferring the cosmetic product from the application element to a surface region of a body.

42. The method of claim 41, wherein the cosmetic product is an eye make-up and the surface region includes eyelashes.

43. The method of claim 41, wherein the product is a nail treatment product and the surface region includes at least one of a fingernail and a toenail.

44. The application device of claim 1, wherein at least a portion of the stem is configured to be grasped by a user during application of the product.

45. The application device of claim 1, wherein the plurality of bristles include a plurality of first bristles having a surface with at least one helical groove extending over at least a portion of a length of each of the first bristles.

46. The application device of claim 45, wherein the plurality of bristles include a plurality of bristles each having a cross-section with at least one hollow portion.

47. The application device of claim 1, wherein the plurality of bristles include a plurality of bristles each having a cross-section with at least one hollow portion.

48. A bristle for an application device for applying a cosmetic product, comprising:

an outer surface having a length; and at least one helical groove extending over at least a portion of the length of the outer surface, wherein the bristle is configured to apply cosmetic product, and wherein the bristle is not yet attached to the application device.

49. The bristle of claim 48, wherein the bristle is configured to apply and eye make-up product.

50. The bristle of claim 48, wherein the bristle is configured to apply a nail treatment product.

51. An application device for applying a cosmetic product, comprising:

a stem; and an application element on the stem, the application element including a plurality of bristles configured to apply a cosmetic product, wherein the plurality of bristles include at least one first hollow bristle having a surface with at least one helical groove extending over at least a portion of a length of the at least one first hollow bristle.

52. An application device for applying a cosmetic product, comprising:

a stem having a longitudinal axis; and an application element on the stem, the application element including a plurality of bristles configured to apply a cosmetic product, the bristles extending from the stem in a direction substantially parallel with the longitudinal axis, wherein the plurality of bristles include at least one first bristle having a surface with at least one helical groove extending over at least a portion of a length of the at least one first bristle.

53. An application system comprising:

the application device of claim 52; and a reservoir configured to contain a nail treatment product capable of being applied with the application device.

54. The system of claim 53, further comprising nail treatment product contained in the reservoir.

55. A method of applying nail treatment product to a surface region of a body, comprising:

providing the application device of claim 52;

placing nail treatment product on the application element; and transferring the nail treatment product from the application element to a surface region of a body.

56. An application device for applying a cosmetic product, comprising:

a stem; and an application element on the stem, the application element including a plurality of bristles configured to apply a cosmetic product, the plurality of bristles including at least one first bristle having a surface with at least one helical groove extending over at least a portion of a length of the at least one first bristle, wherein said at least one first bristle is twisted while in a softened state to form said at least one helical groove.

57. A method of making an application device for applying a cosmetic product, the method comprising:

providing a plurality of wire branches;

forming at least one thermoplastic bristle;

twisting the at least one thermoplastic bristle, while the bristle is in a softened state, to form a helical groove;

inserting a plurality of bristles between the branches, the plurality of bristles including the at least one twisted thermoplastic bristle; and twisting the branches to trap the plurality of bristles.

58. The method of claim 57, wherein said forming comprises extruding the at least one thermoplastic bristle.

59. The method of claim 57, wherein the method further comprises forming the plurality of bristles.

60. The method of claim 59, wherein said forming of the plurality of bristles comprises extruding the plurality of bristles.

61. The method of claim 57, wherein said plurality of branches extend from a bend in a wire.

62. The method of claim 61, wherein the method further comprises forming the bend.

63. The method of claim 57, further comprising connecting the branches to a stem.

64. An application device for applying a cosmetic product, comprising:

a stem; and an application element on the stem, the application element being manufactured according to the method of claim 57.

65. An application device for applying a cosmetic product, the device being manufactured by the method of claim 57.

66. A method of making an application device for applying a cosmetic product, the method comprising:

providing a plurality of wire branches;

providing a plurality of bristles, wherein at least one of the bristles has a surface with at least one helical groove extending over at least a portion of a length of the at least one bristle;

inserting said plurality of bristles between the wire branches, the plurality of inserted bristles including the at least one bristle having a surface with at least one helical groove; and twisting the branches to trap the plurality of bristles.

67. The method of claim 66, wherein the method further comprises forming at least said at least one bristle.

68. The method of claim 66, wherein the method further comprises forming the plurality of bristles.

69. The method of claim 68, wherein said forming of the plurality of bristles comprises extruding the plurality of bristles.

70. The method of claim 68, further comprising forming said helical groove in said at least one bristle.

71. The method of claim 70, wherein said forming of said groove comprises twisting said at least one bristle.

72. The method of claim 66, further comprising forming said helical groove in said at least one bristle.

73. The method of claim 72, wherein said forming of said groove comprises twisting said at least one bristle.

74. The method of claim 66, wherein said plurality of branches extend from a bend in a wire.

75. The method of claim 74, wherein the method further comprises forming the bend.

76. The method of claim 66, further comprising connecting the branches to a stem.

77. An application device for applying a cosmetic, wherein the application device is manufactured according to the method of claim 66.

78. An application device for applying a cosmetic product, comprising:

a stem; and an application element on the stem, the application element being manufactured according to the method of claim 66.

* * * * *

UNITED STATES PATENT AND TRADEMARK OFFICE

CERTIFICATE OF CORRECTION

PATENT NO. : 6,390,708 B1
DATED : May 21, 2002
INVENTOR(S) : Jean-Louis H. Gueret It is certified that error appears in the above-identified patent and that said Letters Patent is hereby corrected as shown below:

Title page,
Item [54], in the Title, "METHOD OF" should read -- METHOD FOR --.

Column 12,
Lines 17-19, delete "Claim 35" in its entirety, and insert therefor:
-- 35. The application system of claim 33, wherein the cosmetic product is one of mascara and nail varnish. --.
Line 24, "production" should read -- excess product --.
Line 32, before "comprises a foam", insert -- wherein the wiper --.
Line 35, "claim 35" should read -- claim 36 --.
Line 6, "apply and" should read -- apply an --.

Column 13,
Line 6, "apply and" should read -- apply an --.

Signed and Sealed this

First Day of October, 2002

*Attest:*

*Attesting Officer*

JAMES E. ROGAN
*Director of the United States Patent and Trademark Office*